US005316448A

United States Patent [19]

Ziegler et al.

[11] Patent Number: 5,316,448

[45] Date of Patent: May 31, 1994

[54] PROCESS AND A DEVICE FOR INCREASING THE EFFICIENCY OF COMPRESSION DEVICES

[75] Inventors: Bruno Ziegler, Wil, Switzerland; Hermann Herzog, Hamburg, Fed. Rep. of Germany; Udo Wagner, Winterthur, Switzerland

[73] Assignee: Linde Aktiengesellschaft, Wiesbaden, Fed. Rep. of Germany

[21] Appl. No.: 959,947

[22] Filed: Oct. 19, 1992

[30] Foreign Application Priority Data

Oct. 18, 1991 [CH] Switzerland ..... 03059/91-7

[51] Int. Cl.[5] ..... F04B 49/00

[52] U.S. Cl. ..... 417/307; 417/309

[58] Field of Search ..... 417/309, 901, 279, 295, 417/307, 299

[56] References Cited

U.S. PATENT DOCUMENTS

| | | | |
|---|---|---|---|
| 4,080,110 | 3/1978 | Szymaszek | 417/309 |
| 4,731,999 | 3/1988 | Niemiec | 417/307 |
| 4,750,867 | 6/1988 | Hertell et al. | 417/307 |
| 5,137,061 | 8/1987 | Deininger et al. | 417/307 |

FOREIGN PATENT DOCUMENTS

| | | | |
|---|---|---|---|
| 0111681 | 5/1991 | Japan | 417/309 |

OTHER PUBLICATIONS

J. Clausen, et al., The Linde-Turborefrigerator For Mr-Tomographs, Advances in Cryogenic Engineering, vol. 35, pp. 949-955, Ed. R. W. Fast, Plenum Press, New York, 1990.

*Primary Examiner*—Richard A. Bertsch
*Assistant Examiner*—Alfred Basichas
*Attorney, Agent, or Firm*—Millen, White, Zelano & Branigan

[57] ABSTRACT

In cryogenic applications a compression device circulates a fluid, such as helium, in a closed cooling circuit. The compression device includes at least one compressor, preferably a helical compressor, with a bypass valve connected in parallel thereto, which serves to decompress the compressed fluid. The suction pressure is measured with a pressure measuring device and is supplied to a control device, which controls the position of a powered valve spool of the compressor and also the position of the bypass valve. In order to achieve a high control performance with small bypass losses for load cases which are hard to predetermine, the positions of bypass valve and power valve spool are adjusted so that a fluid flow flows as a control reserve through the bypass valve and is on the order of a fraction of the total fluid flow.

10 Claims, 4 Drawing Sheets

PROCESS AND A DEVICE FOR INCREASING THE EFFICIENCY OF COMPRESSION DEVICES

BACKGROUND OF THE INVENTION

This invention relates to a process for increasing the efficiency of a compression device and to a device for performing the process.

It is known how to alter the conveyed volume flow of helical compressors of the middle and upper power class by means of an axial power valve spool. The purpose of the power valve spool is to assist and to enable the start-up of the helical compressor during the start phase. During the start phase, the power valve spool is opened, and the compressor only conveys a reduced volume flow. After start-up, the power valve spool is closed; and, during the following operational phase, the volume flow is 100%. In the field of cryogenics, helical compressors are used for the compression of helium, for example. As published in the art "The Linde-Turborefrigerator for MR-Tomographs, J. Clausen et al., Advances in Cryogenic Engineering, Vol. 35, pp. 949-955, Ed. R. W. Fast, Plenum Press, New York, 1990", the control of the suction pressure is known by determining the suction pressure with a pressure measuring device and influencing the rate of mass flow by a bypass valve switched parallel to the helical compressor so that the suction pressure is maintained at constant values.

If this control concept is used in cryogenic installations for load cases which are hard to predetermine, such as, for example, in research centers in the cooling of superconductive magnets, then in partial load operation, which normally lies between 50% and 100% of the maximum conveying capacity, the result is a considerably reduced efficiency of the compression device.

SUMMARY OF THE INVENTION

The objection of the present invention is therefore to improve the efficiency of the compression device for cases with partial loads.

Upon further study of the specification and appended claims, further objects and advantages of this invention will become apparent to those skilled in the art.

According to the invention, this object is achieved by a process with which the control device influences the power valve spool position of the compressor and the position of the bypass valve switched parallel so that the mass flow or the volume flow between the suction side and the pressure side is continuously adapted to the requirements of the cooling process while maintaining the suction pressure constant as far as possible.

In cryogenic applications a compression device circulates a fluid, such as helium, for example, in a closed cooling circuit. The compression device consists of at least one compressor, preferably a helical compressor, and also a bypass valve switched in parallel thereto, which is used to decompress the compressed fluid. The suction pressure is supplied to a control device, which controls the position of the power valve spool of the compressor and also the position of the bypass valve. So as to attain a high control performance with small bypass losses for load cases which are hard to predetermine, the positions of bypass valve and power valve spool are controlled so that a fluid flow flows as a control reserve through bypass valve and is in the order of a fraction of the total fluid flow.

The axially adjustable power valve spool of the helical compressor enables the conveyed volume flow to vary in the range from normally roughly 15% to 100%. One advantage of the invention when compared with known solutions is regarded as being that in partial load operation the mass flow flowing via the bypass valve is reduced or even completely interrupted by controlling the position of the power valve spool, as a result of which there is a substantially greater level of efficiency for the compression device in partial load operation. No power loss occurs when the bypass valve is closed and the volume flow on the suction side determined by the position of the power valve spool brings about the preset pressure. An essential criterium of the compression device is the control performance, in particular the rate of response and the control accuracy with which the suction pressure can be brought into agreement with the preset desired value. The two actuators, i.e., the power valve spool and the bypass valve, have different control characteristics. The power valve spool behaves sluggishly. For a displacement of from 0 to 100% volume flow an execution time of circa 1 minute is required. In addition, its control characteristic is not linear and does not have the same percentage and also cannot be structurally adapted to the requirements of the user. However, the bypass valve has a low delay time and a flow characteristic which can be optimized and thus also has the same percentage, for example. A partial load operation without bypass losses is suitable for stationary processes. If fast pressure changes and small pressure fluctuations have to be controlled, the non-linear control characteristic and also the inertia of the power valve spool have a very negative effect.

In the case of the load which is hard to predetermine with fast pressure changes and small pressure fluctuations, the bypass valve advantageously always stays open to a certain extent. Thus, the bypass valve permits fast control and good control accuracy of the suction pressure. The power valve spool is adjusted more slowly until the mass flow through the bypass valve attains a predetermined desired value range. This bypass flow corresponds to a control reserve which can quickly be controlled. In this case the requirements on the control quality mainly determine the size of the losses in partial load cases. The position of the power valve spool is advantageously not permanently altered for mechanical reasons. The control of the power valve spool may occur with hysteresis. Alterations in the region of the control reserve can also be controlled without adjusting the power valve spool, so that the size of the losses in partial load cases can also be chosen so that movements in the power valve spool are avoided as far as possible.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
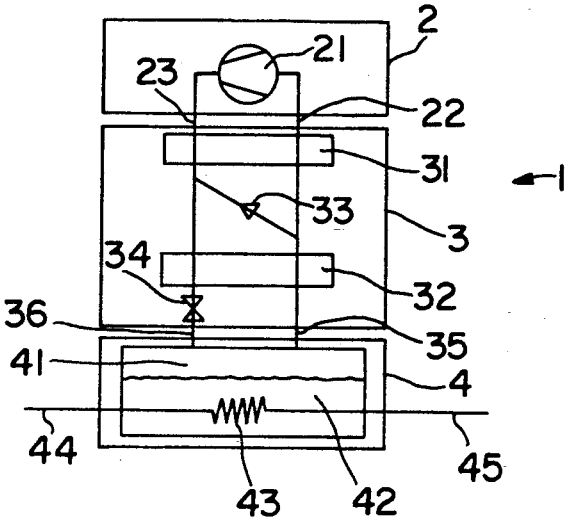
FIG. 1 shows the diagrammatic construction of an installation in which the new process comes to be used.

FIG. 1 shows a cryogenic cooling device 1 for the production of liquid helium, consisting of a controlled compression device 2 having a compressor 21, the cooling circuit of which is connected to a cooler 3 via connecting lines 22, 23. The cooler 3, which consists of two heat exchangers 31, 32, an expansion machine 33 and also a valve 34, is connected to the heat exchanger 4 contains gaseous helium 41, liquid helium 42, and inside, a condensing coil 43 with connecting lines 44, 45, for example.

Figure 2:
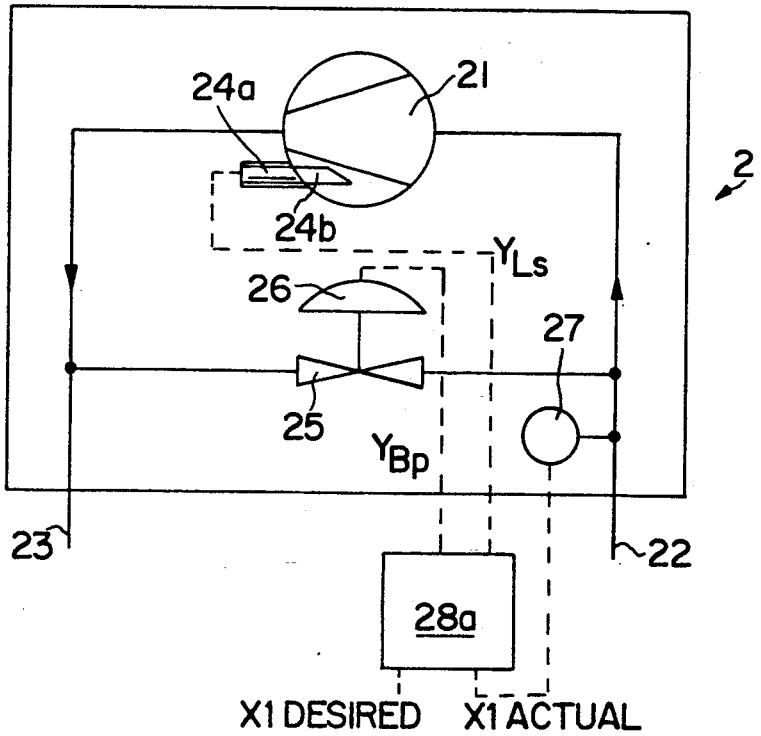
FIG. 2 shows the diagrammatic construction of a controlled compression device for performing the new process.

FIG. 2 shows the controlled compression device 2 with an external control device 28*a*. The helical compressor 21 is provided with an axially displaceable power valve spool 24*b* and a corresponding drive device 24*a*, which is triggered with the error signal $Y_{LS}$. The powered valve spools are used for controlling conventional valves which influence counterpressure, and/or suction pressure and/or volume flow. The pressure control of a compressor is normally performed by varying the size of the opening of a counterpressure valve. The bypass valve 25, which is regulated via a valve drive 26 by error signal $Y_{Bp}$, is disposed parallel to the helical compressor 21. A pressure measuring device 27 registers the suction pressure and conveys the actual value $X1_{actual}$ to the control device 28*a*, which produces the error signals $Y_{LS}$ and also $Y_{Bp}$ after comparison with the desired value $X1_{desired}$. Various strategies are advantageous when controlling the positions of power valve spool 24*b* and bypass valve 25, according to the demands on the compression device and on the consumer. For example, the suction pressure is controlled by the bypass valve 25, as long as the fluid flow of the connected consumer is smaller than the minimum fluid flow which can be conveyed through the compression device 2. When the fluid consumption of the consumer is greater, the bypass valve 25 is closed and the suction pressure is only controlled via the position of the power valve spool 24*b*.

Figure 3:
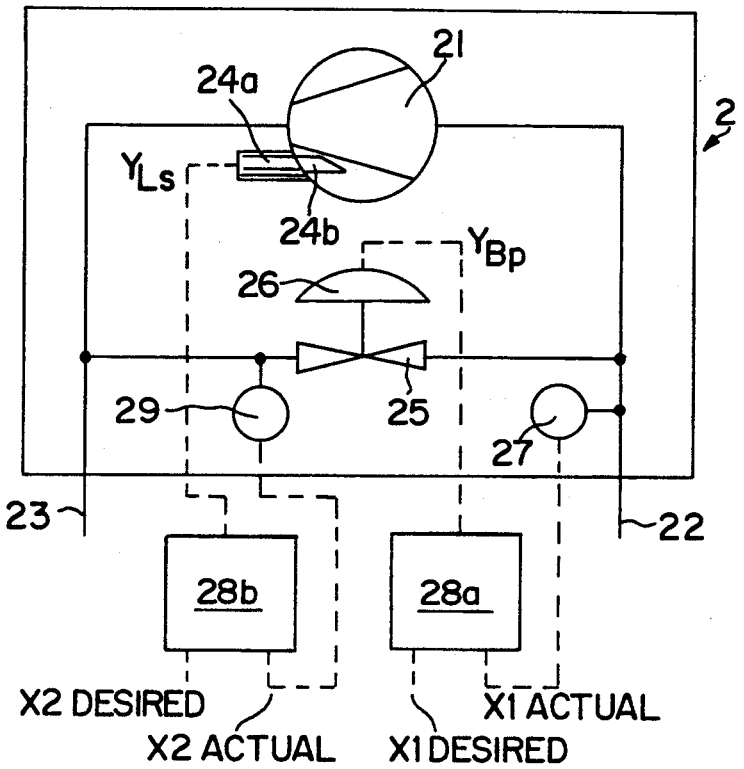
FIG. 3 shows a further diagrammatic construction of a controlled compression device for performing the new process.

The controlled compression device 2 shown in FIG. 3 has a different control concept when compared with FIG. 2. The position of bypass valve 25 is determined by control device 28*a* on the basis of the preset desired value $X1_{desired}$ and of the measured suction pressure $X1_{actual}$. A fluid flow measuring device 29 continually determines the flow through the bypass valve 25 and supplies these values $X2_{actual}$ to a control device 28*b*, which after comparing them with a desired valve $X2_{desired}$ transmits the error signal $Y_{LS}$ to the driving device 24*a* of power valve spool 24*b*. Fast suction pressure changes are controlled by bypass valve 25 provided with a short delay time, which brings about a high control performance, short rate of response and high control accuracy. The control reserve of the fluid flow through bypass valve 25, which can be preset via the desired valve $X2_{desired}$ of control device 28*b*, is adjusted by the sluggish power valve spool 24*b*. The control reserve of a fraction of the total fluid flow, which flows via bypass valve 25, enables a reduction in the bypass losses to a tolerable range with a high control performance. By driving the power valve spool 24*b* with hysteresis, gradually or in stages, the number of movements of the power valve spool 24*b* can be reduced.

Figure 4:
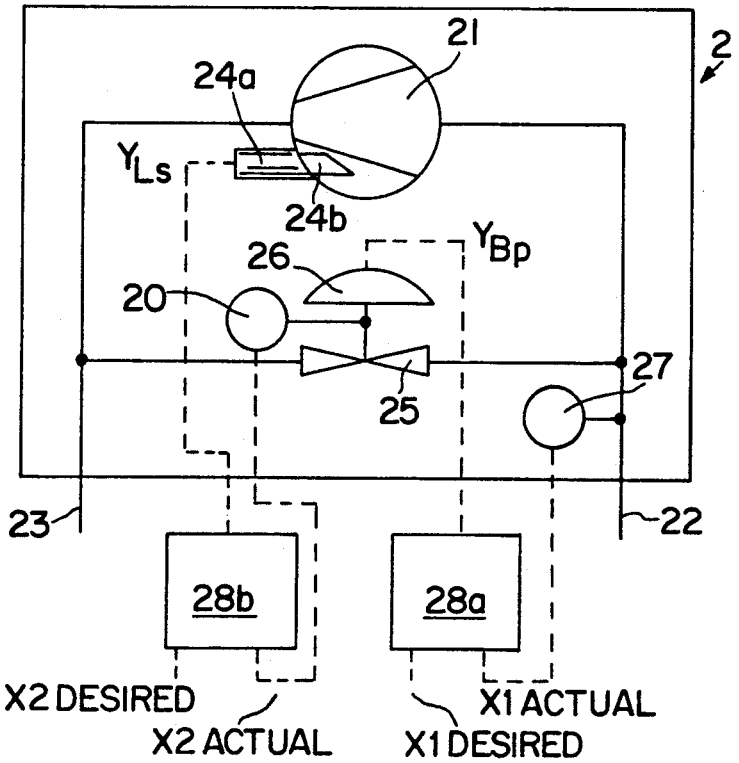
FIG. 4 shows a further diagrammatic control concept of a compression device for performing the new process.

FIG. 4 shows a further control concept of a controlled compression device 2. The position of the bypass valve 25 is again determined on the basis of the suction pressure of the pressure measuring device 27. The mass flow through the bypass valve 25 is determined with a valve lift measuring device 20 and this value $X2_{actual}$ is supplied to a control device 28*b*, which, after comparing it with the preset value $X2_{desired}$ for the mass flow through the bypass valve 25, supplies an error signal $Y_{LS}$ for the drive device 24*a* of the power valve spool 24*b*. Apart from a continual drive of the bypass valve 25 and also of the power valve spool 24*b*, other drive forms are also conceivable, such as gradual or stepwise drives.

Figure 5:
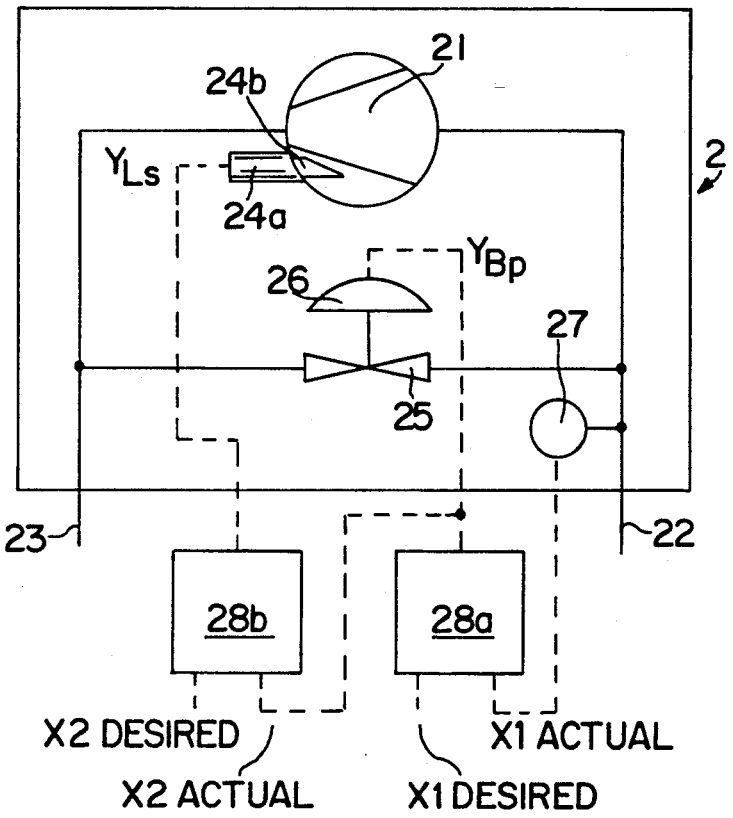
FIG. 5 diagrammatically shows a further control concept of a compression device for performing the new process.

FIG. 5 shows a further control concept of a controlled compression device 2. The suction pressure determined by the pressure measuring device 27 is supplied with the actual variable $X1_{actual}$ to the controller 28*a*, which after comparing it with the desired variable $X1_{desired}$ places the error signal $Y_{Bp}$ at the valve drive 26. The error signal $Y_{Bp}$ is supplied to a subordinated controller 28*b* as actual value $X2_{actual}$, which after being compared with the desired value $X2_{desired}$ emits a correcting variable $H_{La}$ and thus controls the drive device 24*a* of the power valve spool 24*b*. The solution represented with FIG. 5 of a controlled compression device 2 has the advantage that existing compression devices can be operated without any hardware alterations with the control concept specified by the invention.

EXAMPLE OF THE TYPE OF HELICAL COMPRESSOR UTILIZING THE PROCESS

Figure 6:
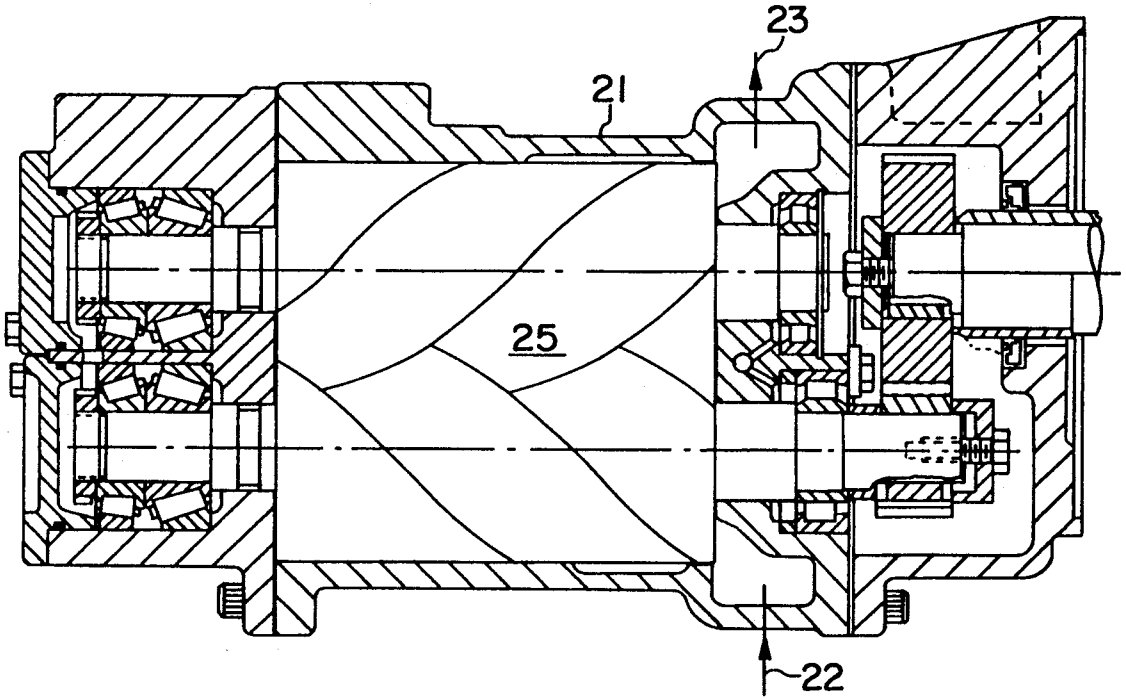
FIG. 6 is a top elevational view of a typical prior art helical compressor with which the process of the present invention is used.

Referring now to FIG. 6, there is shown a typical single stage, conventional compressor 21 which is of the type used as a compressor in FIGS. 1–5. The compressor 21 is illustrated and discussed in *Mark's Standard Handbook for Mechanical Engineers*, Ninth Edition, Avalone el al., sec. 14–38 (1987). The compressor 21 is connected to an input line 22 and an output line 23 (see also FIGS. 1–5). The air is compressed by helixes or screws 25 disposed between the input and output lines 22 and 23, respectfully.

Exemplary of a screw or helix compressor 21 of this type is set forth in J. Clausen et al., supra., which includes the following description of a compressor with which the process of this invention is used.

The single stage screw compressor with a maximum capacity of appr. 7.4 g/s at p=8.4 bar is operated with oil injection and air cooling. Oil separation is performed in five stages with the charcoal/molecular sieve adsorber being installed separately from the compressor unit. Special emphasis has been given to maintain the cleanliness of the cycle gas. Due to the extended periods of operation and the small flow passages within the coldbox even smallest amounts of contaminations may accumulate and result in intolerable pressure drops. Therefore, only special grade synthetic oil with a very small content of volatile condensible material is used. Additionally, the adsorbens is baked out before use to remove carbon dioxide and other gaseous impurities. Arrangement of the complete unit within a sound absorbing casing reduces the noise level of 70 dB(A) and at the same time allows installation both in- and outdoors. The air cooling with internal bypass control keeps the compressor module in operation at ambient temperatures between −20° C. and +40° C. The use of a belt drive and a multi-range motor serve for easy adaption to different electrical power standards (50/60 Hz) by simply exchanging the belt drive wheels. The connection between the compressor and the coldbox is performed by flexible tubes and can vary between 20 m (standard) and 100 m (option).

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for increasing the efficiency of a compressor having a suction line as an input, a pressure line as an output and a counter-pressure valve wherein the compressor compresses a fluid, the process comprising the steps of:

bleeding fluid from the pressure line to the suction line through a bypass valve disposed in parallel with the compressor;

monitoring the pressure in the suction line to provide a first signal indicative of the actual pressure in the suction line; and comparing the first signal to a second signal indicative of a desired suction line pressure to produce a first error signal for controlling the size of the opening of the counter-pressure valve in the compressor which counter-pressure valve controls the suction pressure, and providing a second error signal which controls the size of the opening of the bypass valve, wherein fluid flow between the suction and pressure lines is adapted to the requirements of the cooling process while maintaining the suction pressure substantially constant.

2. The process of claim 1, wherein the fluid is helium and the compressor is a helical compressor.

3. The process of claim 1, wherein the second error signal is produced by comparing the first and second signals.

4. The process of claim 1, wherein the second error signal is produced by comparing the output of the bypass valve to a desired output of the bypass valve.

5. The process of claim 1, wherein the second error signal is produced by comparing the position of an output valve operator to a desired position thereof.

6. A process according to claim 1, wherein the position of the bypass valve (25) is controlled as a function of the pressure of the suction side, whereas the position of the power valve spool (**24*b*) is controlled by a measuring device (29), which ascertains the fluid flow through the bypass valve (25**).

7. A process according to claim 1, wherein the position of the power valve spool (**24*b*) is controlled as a function of the position of the bypass valve (25**).

8. A process according to claim 1, wherein to reduce the number of movements of the power valve spool (**24*b***) its control is provided with an adjustable hysteresis.

9. A process for increasing the efficiency of the compressor having a suction line as an input, a pressure line as an output and a counter-pressure valve wherein the compressor compresses a fluid, the process comprising the steps of:

bleeding fluid from the pressure line to the suction line through a bypass valve disposed in parallel with the compressor;

monitoring the pressure in the suction line to provide a first signal indicative of the actual pressure in the suction line;

comparing the first signal to a second signal indicative of a desired suction line pressure to produce a first error signal for controlling the size of the opening of the bypass valve; and using the first error signal to generate a second error signal for controlling the size of the opening of the counter-pressure valve by comparing the first error signal to a desired error signal to produce the second error signal.

10. The process of claim 9, wherein the fluid is helium and the compressor is a helical compressor.

* * * * *